US005623726A

United States Patent [19]

Kiiski et al.

[11] Patent Number: 5,623,726

[45] Date of Patent: Apr. 22, 1997

[54] ROLL MANUFACTURE

[75] Inventors: Erkki Kiiski; Jari Liimatainen; Hannu Martikainen, all of Tampere, Finland

[73] Assignee: Rauma Materials Technology OY, Tampere, Finland

[21] Appl. No.: 499,190

[22] Filed: Jul. 7, 1995

[30] Foreign Application Priority Data

Jul. 11, 1994 [FI] Finland ..... 943285

[51] Int. Cl.[6] ..... B22F 1/00

[52] U.S. Cl. ..... 419/23; 419/42; 419/49

[58] Field of Search ..... 419/23, 42, 49

[56] References Cited

U.S. PATENT DOCUMENTS 4,340,432 7/1982 Hede .
4,740,254 4/1988 Rainger et al. .
4,770,703 9/1988 Tarutani et al. .
4,964,924 10/1990 Yoshitake et al. ..... 148/325
5,114,470 5/1992 Biancaniello et al. .

FOREIGN PATENT DOCUMENTS 0594935 5/1994 European Pat. Off. .
86747 6/1992 Finland .
4-253514 9/1992 Japan .

*Primary Examiner*—Charles T. Jordan
*Assistant Examiner*—Anthony R. Chi
*Attorney, Agent, or Firm*—Burns, Doane, Swecker & Mathis

[57] ABSTRACT

The invention relates to the manufacture of paper machine roll shells of stainless steel. According to the invention, powder is made of molten steel by gas-atomizing, a roll shell preform is made of the powder, and the roll shell preform is machined to form a roll shell. The main advantage of the rolls shells according to the invention is their good corrosion fatigue resistance.

30 Claims, 2 Drawing Sheets

ROLL MANUFACTURE

FIELD OF TECHNOLOGY

The invention relates to the manufacture of paper machine rolls of stainless steel. As used herein, a paper machine generally means both paper and board machines.

TECHNOLOGICAL BACKGROUND

In operation, the paper machine rolls are subject simultaneously to mechanical strain, corrosion and wear. A cyclically varying load is typical of strain. Corrosion again results primarily from a relatively high operating temperature and from chlorides existing in the process environment.

Stainless and stainless duplex steels of various types are used at present as roll material. Duplex steel is characterized by a microstructure containing both ferrite and austenite. Equal volume shares are usually aimed at for these. Due to its two-phase microstructure, duplex steel features a good corrosion fatigue resistance.

Roll shells are nowadays made by a centrifugal method by casting or by welding of rolled sheet or by forging.

For example, printed patent publication FI-86747 presents a cast steel intended for paper machine rolls. It has the following composition: C max 0.10%, Si max 1.5%, Mn max 2.0%, Cr 25.0–27.0%, Ni 5.0–7.5%, Cu 1.5–3.5%, N max 0.15%, Mo max 0.5%.

DESCRIPTION OF THE INVENTION

General description

A method of making a paper machine roll shell as defined in claim 1 has now been invented. The other claims define some advantageous applications of the invention.

According to the invention, a roll shell preform is made of gas-atomized steel powder either by hot-isostatic pressing or by extrusion.

The major advantage of roll shells according to the invention is their good corrosion fatigue resistance.

DETAILED DESCRIPTION

Figure 1:
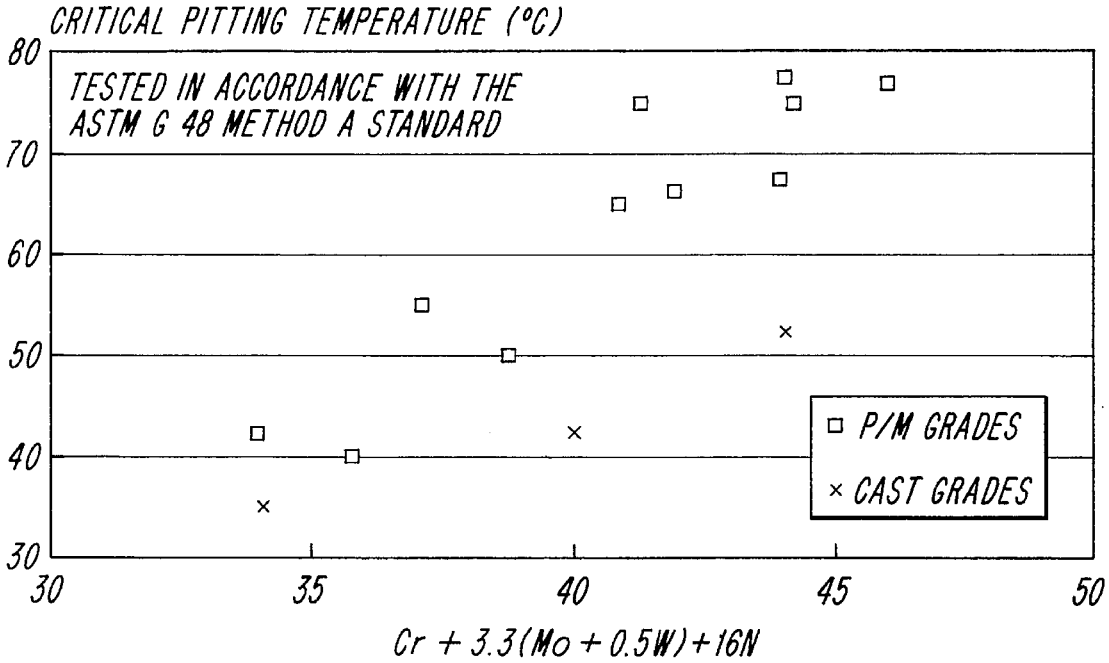
FIG. 1 shows the pitting resistance of duplex steels made in accordance with the invention (P/M) and by conventional casting.

The usual length of paper machine rolls is 5–10 m, diameter 0.5–1.3 m and wall thickness 50–80 mm. The rotation speeds of rolls may be as high as 1500 RPM, that is, the number of load variations causing fatigue cracking is 25 variations a second.

Corrosion strongly accelerates the initiation of fatigue damage resulting from cyclical loads. In fact, corrosion fatigue is the most frequent damage mechanism in suction roll shells. It typically initiates to casting or welding defects, corrosion pits or non-metallic slag inclusions.

Casting defects arise during solidification as solidification defects or as gas inclusions.

Pitting typically originates in a breakage occurring in the passive film of the steel surface, which under the influence of, for example, chlorides brings about a local active area and therein a high corrosion current density and thus quick pit corrosion. External loads promote breaking of the passive film.

Non-metallic slag inclusions, such as oxides and sulphides, may act as initiation sites for the fatigue cracking due to their local notch effect. In addition, e.g. manganese sulphides may dissolve due to the corrosion, whereby the resulting pitting will initiate the fatigue cracking.

After initiation of the fatigue cracking, the crack will proceed under the effect of simultaneous corrosion and a cyclically varying external strain.

In the present invention, the roll shell is made of gas-atomized and pre-alloyed steel powder. The powder is made, for example, by first making molten steel of the desired kind which is then subjected to an inert gas jet. The gas jet will break up the molten steel into small particles, mainly of a size of less than 500 micrometers, and the particles will solidify quickly. In practice, atomization is performed by pouring molten steel through special ceramic nozzles of a certain type and into a special atomization chamber.

The powder is solidified either through hot-isostatic pressing or through hot-extrusion so that no pores will remain in the product.

In hot-isostatic pressing, a mould is first made of thin sheet and it is filled with steel powder. Compaction of the powder must be taken into account in dimensioning the mould, so that the final dimension is as close as possible to the desired one. The filled mould is evacuated, it is sealed hermetically and moved into a hot-isostatic press. In this, inert gas (argon), a high temperature and pressure are applied to the mould, whereby the mould is compressed and the powder densifies due to plastical deformation, creep and diffusion. A typical pressure is 100–120 MPa, temperature 1100°–1200° C. and pressing time at least 3 h for stainless steels. The mould is removed from the surface by etching or machining.

In powder extrusion, a steel mould is first filled with powder. If desired, the powder in the mould may be compacted to some degree by cold pressing. The mould is then preheated and extruded into the desired shape. Alternatively, the mould is first hot pressed in a special mould so that a somewhat densified preform is obtained. Finally, the preform is hot-extruded. Typical extrusion temperatures are in the range of 1100°–1300° C. The treatment and extrusion time for the extrusion preform is a few minutes.

Before extrusion, the preform can be further densified by punching. In punching, a special punching tool is first pushed through the preform, whereby forming is brought about in the preform and the powder will compact very close to a density of 100%. At the same time, the preform becomes tubelike.

Either method can be used for making roll shells of an absolutely dense material, without any pores or defects that could act as initiators of fatigue cracks.

In gas atomization, the particles solidify very quickly, whereby their composition becomes fully homogenous throughout the particle. In this way, also the distribution of alloying elements will be fully homogenous in the roll material. On the other hand, as castings solidify, both micro- and macro-segregation will occur in the body, with the result that the composition of the solidified material will be different from the desired optimum composition in different parts of the body. In a roll manufactured in accordance with the invention, the material's corrosion fatigue resistance, for example, is uniformly high throughout the body. Nor has the body any defects resulting from too high local contents of alloying elements. In the method according to the invention, one may use high chromium and molybdenum alloying, which improves the corrosion resistance, without any resulting embrittling phases, such as a sigma-phase, which would also reduce the corrosion resistance.

No gas pores are formed in the powder particles as they cool quickly. Thus, a relatively high nitrogen level may also be used in alloying, if desired, in order to improve further both the strength and the corrosion resistance.

By hot-isostatic pressing or by extrusion a preform can be made directly with the desired roll shape, and the preform is then machined to make the final product. It may be necessary to make big rolls from several sector-shaped parts, which are joined together by welding. By pressing it is also possible first to make an intermediate preform which is given its final shape by hot-working. Workability is good, because there is no tearing risk caused by segregation in the body.

The powder material is austenitic-ferritic stainless steel. The formula is especially as follows

| | | |
|---|---|---|
| C | max 0.08 | preferably max 0.03 |
| Si | max 2 | preferably max 1.5 |
| Mn | max 2 | preferably max 1.5 |
| Cr | 18–29 | preferably 23–28 |
| Mo | 1.5–4.5 | preferably 2.5–3.5 |
| Ni | 4.5–9 | preferably 6.5–8.5 |
| Cu | max 3 | preferably 1–2.5 |
| N | 0.1–0.35 | preferably 0.18–0.25 |
| S | max 0.03 | preferably max 0.005 |
| P | max 0.03 | preferably max 0.025 |
| Al | max 0.1 | preferably max 0.02 |

The following formula is especially suitable for big rolls:

| | | |
|---|---|---|
| C | max 0.03 | preferably max 0.02 |
| Si | max 1.5 | preferably max 1 |
| Mn | max 1.5 | preferably 0.6–1 |
| Cr | 24–28 | preferably 25–27 |
| Mo | 2.5–3.5 | preferably 2.75–3.25 |
| Ni | 6.5–8 | preferably 7–7.5 |
| Cu | max 3 | preferably 1.5–2.5 |
| N | 0.15–0.3 | preferably 0.18–0.25 |
| S | max 0.03 | preferably max 0.005 |
| P | max 0.03 | preferably max 0.025 |
| Al | max 0.1 | preferably max 0.02 |

In addition, small quantities of other alloy materials may be used, if desired, such as a maximum quantity of 3% of tungsten, and a total maximum quantity of 0.5% of vanadium, niobium and titanium.

The corrosion resistance of steel grades for use in the invention can be described by the so-called PREN index (Pitting resistance equivalent with nitrogen), which is calculated from Cr, Mo and N contents using the formula $$PREN=Cr\text{-}\%+3.3*Mo\text{-}\%+16*N\text{-}\%$$

If tungsten is also used, the PRENW index is used, whereby $$PRENW=Cr\text{-}\%+3.3*(Mo\text{-}\%+0.5*W\text{-}\%)+16*N\text{-}\%$$

FIG. 1 shows the pitting resistance of duplex steels made in accordance with the invention (P/M) and by conventional casting, respectively, as functions of the PRENW index. With products made in accordance with the invention, pitting resistance is essentially better and, in addition, the increased alloying degree improves pitting resistance relatively more than with cast products.

Figure 2:
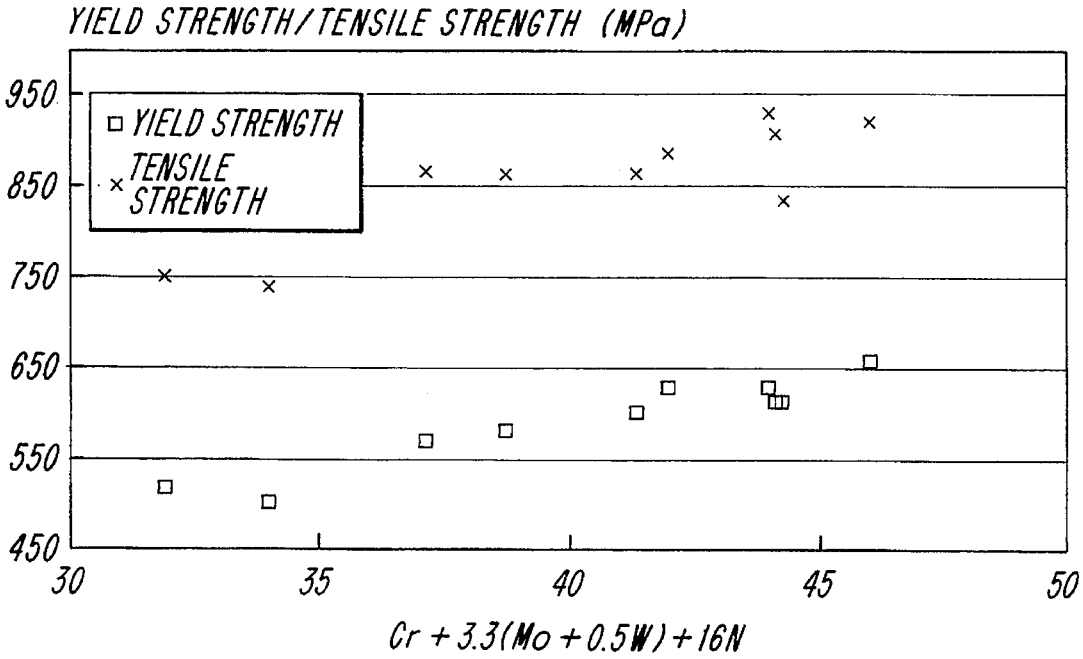
FIG. 2 shows the yield strength and tensile strength of duplex steels made in accordance with the invention (P/M) and by conventional casting.

Both the yield strength and the tensile strength are increased along with a growing PREN index, which is shown by FIG. 2.

Figure 3:
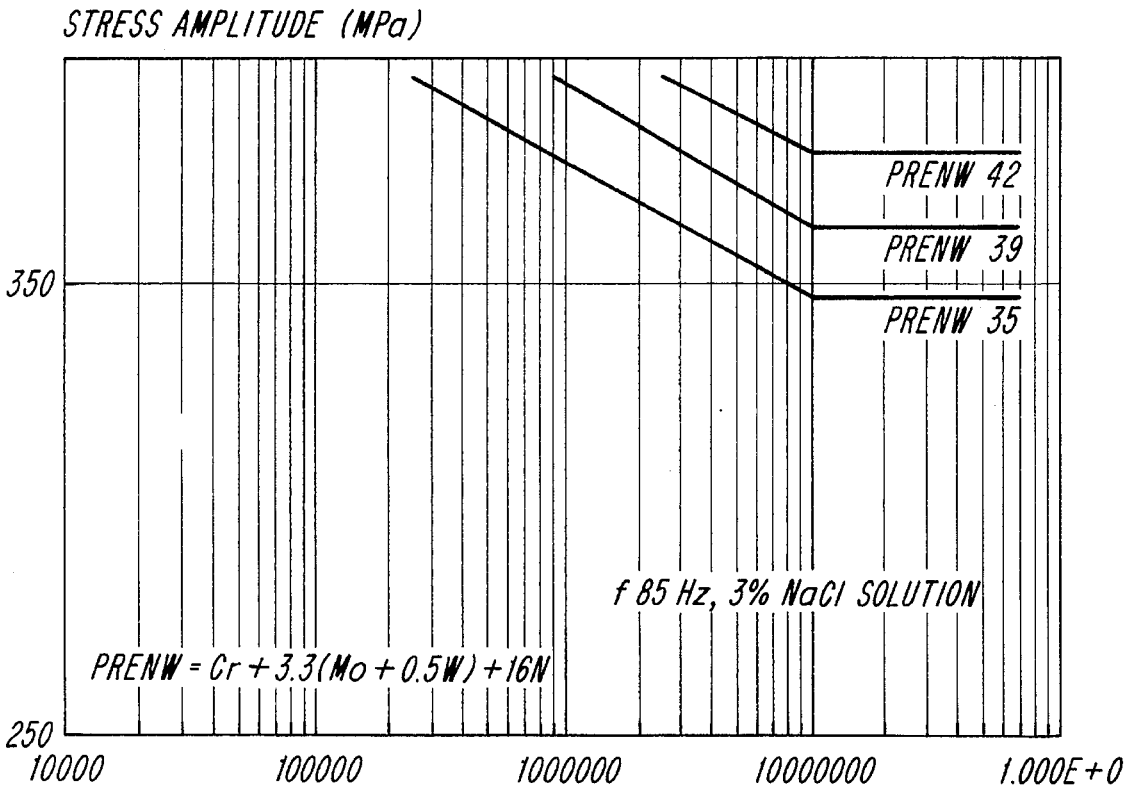
FIG. 3 shows the effect of the PREN index on the corrosion fatigue resistance.

FIG. 3 shows the effect of the PRENW index on the corrosion fatigue resistance. The test used was a rotating-bending fatigue test (f 85 Hz, 3-% NaCl solution). The horizontal axis shows the number of load variations before breakage. It can be seen that as the PRENW index increases the corrosion fatigue resistance also improves.

Figure 4:
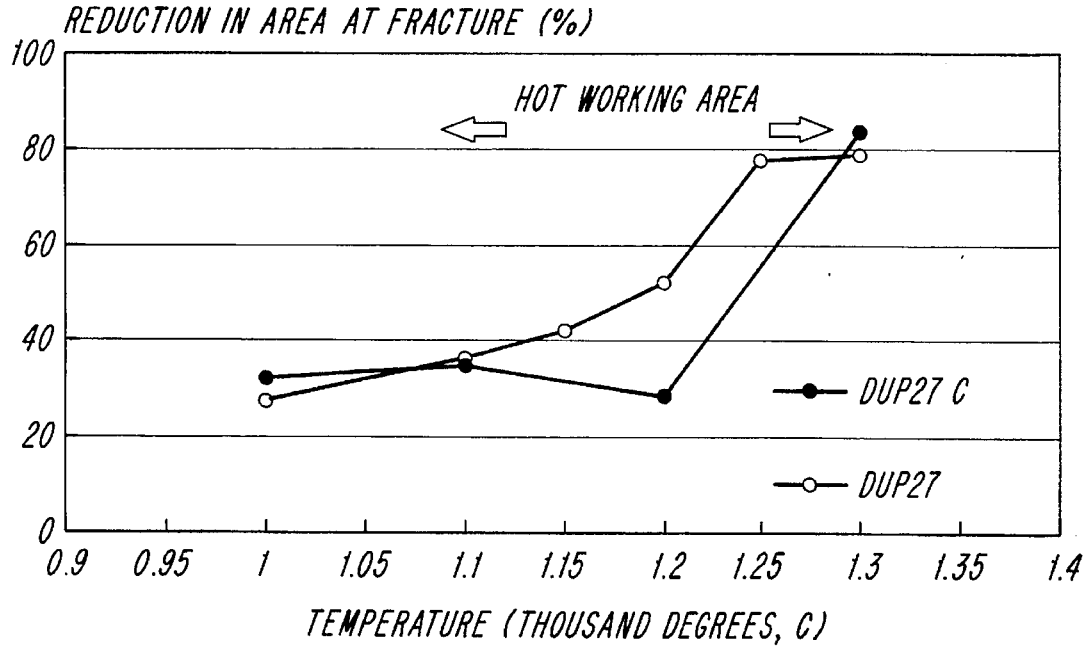
FIG. 4 compares a preform (DUP27) made of powder by hot isostatic pressing with a cast preform (DUP27 C) as regards their hot-workability.

FIG. 4 compares a preform (DUP27) made of powder by hot-isostatic pressing with a cast preform (DUP27 C) as regards their hot-workability. The toughness of the pressed preform was measured here by the reduction in area at fracture. It can be seen that the pressed preform is just in the hot-working temperature area clearly better than the cast preform.

The PRENW (or PREN) index is preferably over 35 and most preferably over 40.

The aim is to keep the oxygen content of the steel powder as low as possible. It is preferably less than 250 ppm. A low oxygen level is achieved through careful treatment of the powder, by controlling the purity of the atomization gas and through correct treatment and manufacture of the capsule material.

Big particles are also preferably removed by screening from the steel powder before use. The preferable maximum powder size is 500 micrometers and most preferably no more than 250 micrometers. In this way, any formation especially of big non-metallic inclusions is prevented in the final product. Such inclusions are troublesome especially as regards fatigue resistance.

We claim:

1. Method of manufacturing a roll shell of steel so that powder is made from molten steel by inert gas atomization, a roll shell preform or a section of a roll shell preform is made of the powder so that a mould is filled with the powder and at a high temperature brought under pressure and/or hot working, and sections of a roll shell preform, if such have been made, are joined together to form a roll shell preform, and the roll shell preform is machined to form a roll shell, characterized in that austenitic-ferritic stainless steel is used as steel, and a paper or board machine roll shell or roll shell preform is made of it.

2. Method according to claim 1, characterized in that the pressing is carried out hot-isostatically.

3. Method in accordance with claim 1, characterized in that an intermediate preform is made of powder by hot-isostatic pressing and the final roll shell preform or section of a roll shell preform is made of this by hot working.

4. Method in accordance with claim 1, characterized in that the steel has the following composition in percentage by weight:

| | |
|---|---|
| C | max 0.08 |
| Si | max 2 |
| Mn | max 2 |
| Cr | 18–29 |
| Mo | 1.5–4.5 |
| Ni | 4.5–9 |
| Cu | max 3 |
| N | 0.1–0.35 |
| S | max 0.03 |
| P | max 0.03 |
| Al | max 0.1. |

5. Method in accordance with claim 4, characterized in that the composition is:

| | |
|---|---|
| C | max 0.03 |
| Si | max 1.5 |
| Mn | max 1.5 |
| Cr | 24–28 |
| Mo | 2.5–3.5 |
| Ni | 6.5–8 |
| Cu | max 3 |
| N | 0.15–0.3 |
| S | max 0.03 |
| P | max 0.03 |
| Al | max 0.1. |

6. Method in accordance with claim 4, characterized in that as alloy material, the steel also contains no more than 3% of tungsten or a maximum total quantity of 0.5% of vanadium, niobium or titanium.

7. Method in accordance with claim 1 for manufacturing a suction roll.

8. Method in accordance with claim 1, characterized in that the PRENW index of the steel, $$PRENW=Cr\text{-}\%+3.3*(Mo\text{-}\%+0.5*W\text{-}\%)+16*N\text{-}\%,$$

is over 35.

9. Method in accordance with claim 1, characterized in that powder with a maximum oxygen content of 250 ppm is made.

10. Method in accordance with claim 1, characterized in that before making the preform, such particles are removed from the powder the size of which is over 500 micrometers.

11. Method in accordance with claim 2, characterized in that an intermediate preform is made of powder by hot-isostatic pressing and the final roll shell preform or section of a roll shell preform is made of this by hot working.

12. Method in accordance with claim 2, characterized in that the steel has the following composition in percentage by weight:

| | |
|---|---|
| C | max 0.08 |
| Si | max 2 |
| Mn | max 2 |
| Cr | 18–29 |
| Mo | 1.5–4.5 |
| Ni | 4.5–9 |
| Cu | max 3 |
| N | 0.1–0.35 |
| S | max 0.03 |
| P | max 0.03 |
| Al | max 0.1. |

13. Method in accordance with claim 3, characterized in that the steel has the following composition in percentage by weight:

| | |
|---|---|
| C | max 0.08 |
| Si | max 2 |
| Mn | max 2 |
| Cr | 18–29 |
| Mo | 1.5–4.5 |
| Ni | 4.5–9 |
| Cu | max 3 |
| N | 0.1–0.35 |
| S | max 0.03 |
| P | max 0.03 |
| Al | max 0.1. |

14. Method in accordance with claim 11, characterized in that the steel has the following composition in percentage by weight:

| | |
|---|---|
| C | max 0.08 |
| Si | max 2 |
| Mn | max 2 |
| Cr | 18–29 |
| Mo | 1.5–4.5 |
| Ni | 4.5–9 |
| Cu | max 3 |
| N | 0.1–0.35 |
| S | max 0.03 |
| P | max 0.03 |
| Al | max 0.1. |

15. Method in accordance with claim 2 for manufacturing a suction roll.

16. Method in accordance with claim 3 for manufacturing a suction roll.

17. Method in accordance with claim 2, characterized in that the PRENW index of the steel, $$PRENW=Cr\text{-}\%+3.3*(Mo\text{-}\%+0.5*W\text{-}\%)+16*N\text{-}\%,$$

is over 35.

18. Method in accordance with claim 3, characterized in that the PRENW index of the steel, $$PRENW=Cr\text{-}\%+3.3*(Mo\text{-}\%+0.5*W\text{-}\%)+16*N\text{-}\%,$$

is over 35.

19. Method in accordance with claim 2, characterized in that powder with a maximum oxygen content of 250 ppm is made.

20. Method in accordance with claim 2, characterized in that before making the preform, such particles are removed from the powder the size of which is over 500 micrometers.

21. Method in accordance with claim 1, characterized in that the steel has the following composition in percentage by weight:

| | |
|---|---|
| C | max 0.03 |
| Si | max 1.5 |
| Mn | max 1.5 |
| Cr | 23–28 |
| Mo | 2.5–3.5 |
| Ni | 6.5–8.5 |
| Cu | 1–2.5 |
| N | 0.18–0.25 |
| S | max 0.005 |
| P | max 0.025 |
| Al | max 0.02. |

22. Method in accordance with claim 4, characterized in that the composition is:

| | |
|---|---|
| C | max 0.02 |
| Si | max 1 |
| Mn | 0.6–1 |
| Cr | 25–27 |
| Mo | 2.75–3.25 |
| Ni | 7–7.5 |
| Cu | 1.5–2.5 |
| N | 0.18–0.25 |
| S | max 0.005 |
| P | max 0.025 |
| Al | max 0.02. |

23. Method in accordance with claim 1, characterized in that the PRENW index of the steel, $$PRENW=Cr\text{-}\%+3.3*(Mo\text{-}\%+0.5*W\text{-}\%)+16*N\text{-}\%,$$

is over 40.

24. Method in accordance with claim 1, characterized in that before making the preform, such particles are removed from the powder the size of which is over 250 micrometers.

25. Method in accordance with claim 2, characterized in that the steel has the following composition in percentage by weight:

| | |
|---|---|
| C | max 0.03 |
| Si | max 1.5 |
| Mn | max 1.5 |
| Cr | 23–28 |
| Mo | 2.5–3.5 |
| Ni | 6.5–8.5 |
| Cu | 1–2.5 |
| N | 0.18–0.25 |
| S | max 0.005 |
| P | max 0.025 |
| Al | max 0.02. |

26. Method in accordance with claim 3, characterized in that the steel has the following composition in percentage by weight:

| | |
|---|---|
| C | max 0.03 |
| Si | max 1.5 |

-continued

| | |
|---|---|
| Mn | max 1.5 |
| Cr | 23–28 |
| Mo | 2.5–3.5 |
| Ni | 6.5–8.5 |
| Cu | 1–2.5 |
| N | 0.18–0.25 |
| S | max 0.005 |
| P | max 0.025 |
| Al | max 0.02. |

27. Method in accordance with claim 11, characterized in that the steel has the following composition in percentage by weight:

| | |
|---|---|
| C | max 0.03 |
| Si | max 1.5 |
| Mn | max 1.5 |
| Cr | 23–28 |
| Mo | 2.5–3.5 |
| Ni | 6.5–8.5 |
| Cu | 1–2.5 |
| N | 0.18–0.25 |
| S | max 0.005 |
| P | max 0.025 |
| Al | max 0.02. |

28. Method in accordance with claim 2, characterized in that the PRENW index of the steel, $$PRENW=Cr\text{-}\%+3.3*(Mo\text{-}\%+0.5*W\text{-}\%)+16*N\text{-}\%,$$

is over 40.

29. Method in accordance with claim 3, characterized in that the PRENW index of the steel, $$PRENW=Cr\text{-}\%+3.3*(Mo\text{-}\%+0.5*W\text{-}\%)+16*N\text{-}\%,$$

is over 40.

30. Method in accordance with claim 2, characterized in that before making the preform, such particles are removed from the powder the size of which is over 250 micrometers.

* * * * *